United States Patent [19]

Hruda

[11] 4,414,447

[45] Nov. 8, 1983

[54] LOW DC VOLTAGE, HIGH CURRENT SWITCH ASSEMBLY

[75] Inventor: Robert M. Hruda, Horseheads, N.Y.

[73] Assignee: Westinghouse Electric Corp., Pittsburgh, Pa.

[21] Appl. No.: 267,827

[22] Filed: May 27, 1981

[51] Int. Cl.[3] ..... H01H 33/66

[52] U.S. Cl. ..... 200/144 B; 200/144 AP; 338/53

[58] Field of Search ..... 200/144 B, 144 AP; 338/53, 55, 57

[56] References Cited

U.S. PATENT DOCUMENTS

| | | | |
|---|---|---|---|
| 1,905,751 | 4/1933 | Rankin | 200/144 B |
| 3,261,953 | 7/1966 | Tilman et al. | 200/144 B |
| 4,005,297 | 1/1977 | Cleaveland | 200/144 B |
| 4,069,406 | 1/1978 | Meinders | 200/144 AP |
| 4,216,359 | 8/1980 | Hruda | 200/144 B |
| 4,227,987 | 10/1980 | Kircher et al. | 204/228 |
| 4,302,642 | 11/1981 | Hruda et al. | 200/144 B |

FOREIGN PATENT DOCUMENTS

| | | | |
|---|---|---|---|
| 687591 | 2/1940 | Fed. Rep. of Germany | 338/53 |
| 287843 | 8/1928 | United Kingdom | 200/144 B |

*Primary Examiner*—Robert S. Macon

*Attorney, Agent, or Firm*—W. G. Sutcliff

[57] ABSTRACT

A low voltage, high continuous current DC switch assembly is provided having integral switch operating means with the switch and a resistance means which is fluid cooled. This switch assembly is particularly adapted to function as a shunt switch assembly connectable between generally parallel spaced apart electrical terminals which extend from or are connectable to an electrochemical cell. The switch assembly is modular in that a plurality can be assembled together as electrically parallel shunt paths.

16 Claims, 3 Drawing Figures

LOW DC VOLTAGE, HIGH CURRENT SWITCH ASSEMBLY

BACKGROUND OF THE INVENTION

The present invention relates to an electrical switch assembly which is designed for low voltage, high continuous operating current, DC voltage operation. The switch assembly is adapted for use as a parallel path electrical shunt for use across the terminals of electrochemical cells, particularly for diaphragm type cells with operating currents of about 150,000 amperes or greater.

Such an electrochemical cell is discussed in U.S. Pat. No. 4,227,987, and a plurality of cells are typically provided in series with a constant current power supply. The shunt switch assembly is connectable across the terminals of an electrochemical cell to permit the cell to be isolated from the operating system for servicing or replacement without having to shut down the entire system. The shunt switch assembly should be an efficient current bypass device which can be operated to interrupt the very high current and to divert the system current back through the repaired cell.

It has been the practice in the industry to use electrical switches for such shunts or bypass switches which were knife edge contactors or similar air gap contacts. A recent innovation has been to use vacuum shorting switches in a bypass shunting switch assembly as described in U.S. Pat. No. 4,216,359. A multi vacuum switch shunting assembly designed for approximately simultaneous operation of the parallel connecting vacuum switches in described in U.S. Pat. No. 4,302,642 filed Aug. 24, 1977, entitled "Vacuum Switch Assembly," owned by the assignee of the present invention. In the aforementioned copending application generally tubular bus conductors of a predetermined resistance value extend from each vacuum switch to the cell terminals. These tubular bus conductors are closely spaced and aligned to minimize inductance. Another vacuum switch shunting assembly is described in U.S. Pat. No. 4,370,530 filed May 28, 1980, entitled "Electrolytic Cell Electrical Shunting Switch Assembly," owned by the assignee of the present invention. The plurality of parallel connected vacuum switches in the aforementioned copending application each have a series connected resistor and are individually operable with a separate air cylinder.

It is desirable that a shunting switch assembly for use with an electrochemical cell be as compact as possible to minimize bus conductor material costs and inductance effects. The electrical switches of the assembly must be able to efficiently pass the bypass system current without overheating and without undue losses. The electrical switches must be capable of diverting the system current back through the cell and to dissipate the interrupted arc current.

SUMMARY OF THE INVENTION

A low voltage, high continuous current DC switch assembly is provided and is particularly adapted for connection and operation across the terminals of an electrochemical cell. The switch assembly is a compact, modular design easily varied to change the power rating and to closely match the cell characteristics.

The switch assembly comprises a low voltage, high current DC switch having a hermetically sealed envelope with a pair of relatively reciprocally movable electrical contacts sealed through the envelope. The switch operating means has a body portion which is rigidly connected to one contact of the switch, and a reciprocally movable drive member which is connected to the other switch contact. The resistance means is a tubular element with end plates sealed to each end. A first end plate is connected to one of the switch contacts, while the second end plate is connectable to a rigid electrical terminal. An inlet cooling fluid tubulation passes through the second end plate and extends coaxially within the tubular resistive element with an outlet tubulation passing through the tubular element proximate the second end plate. The cooling fluid is directed against the end plate in contact with the switch contact to effect cooling of the switch as well as the tubular resistance element.

DESCRIPTION OF THE PREFERRED EMBODIMENT

Figure 1:
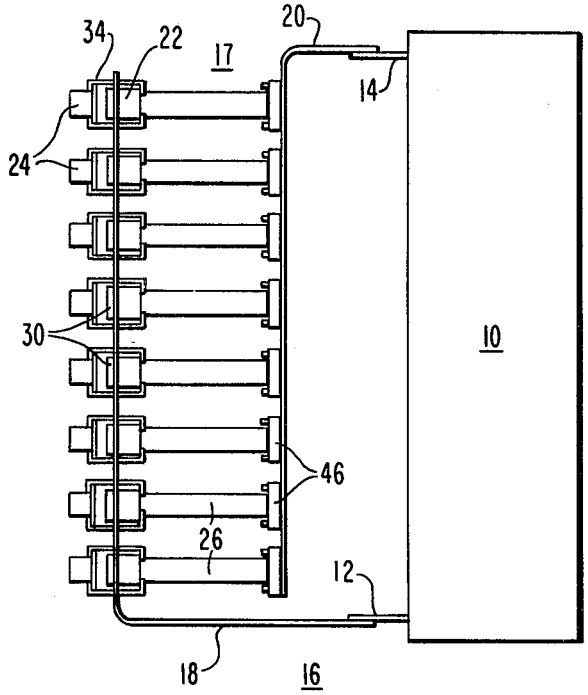
FIG. 1 is a schematic representation of an embodiment of a switch assembly of the present invention connected across the terminals of an electrochemical cell.
Figure 3:
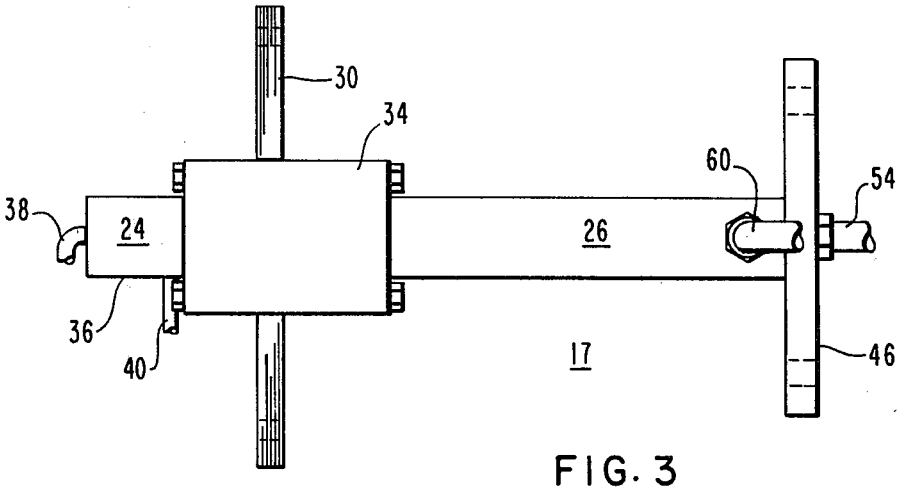
FIG. 3 is a view from the top of the FIG. 2 view.
Figure 2:
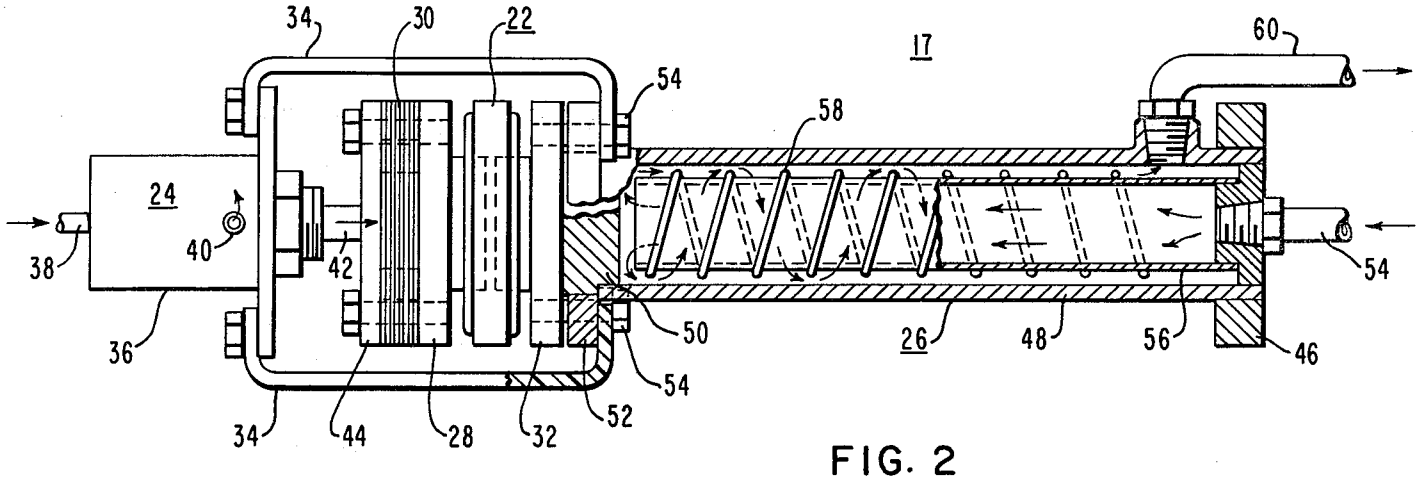
FIG. 2 is a side elevation view partly in section of switch assembly of the present invention.

The present invention can be best understood by reference to the exemplary embodiments seen in FIGS. 1–3. In FIG. 1, an electrochemical cell 10 is one of a series of cells which are serially electrically connected to a constant current DC power supply not shown. A pair of electrical terminals or leads 12, 14 extend from the cell 10, and are respectively connected to the apposed anode and cathode electrodes within the cell. A low voltage, high current DC switch assembly 16 is connected across the cell terminals 12, 14 to operate as a parallel shunting electrical path around the cell 10.

The switch assembly 16 is connected to terminals 12 and 14 by respective bus conductors 18 and 20. The switch assembly 16 includes a plurality of identical electrically parallel path sub-assemblies 17 with eight such sub-assemblies 17 seen in FIG. 1. Each of these sub-assemblies includes a hermetically sealed, low DC voltage, high continuous current rated electrical switch 22, a switch operating means 24, and a generally tubular resistive element 26. The sub-assemblies 17 are connected in electrical parallel between bus conductors 18, 20.

An individual sub-assembly 17 is seen in greater detail in FIGS. 2 and 3. The electrical switch 22 is a hermetically sealed device which is evacuated and the contacts are separable within the vacuum to effect current interruption when it is desired to divert the current back through the cell. Such vacuum electrical switch is described in detail in U.S. Pat. No. 4,216,361. The switch 22 has a flexible diaphragm envelope portion to permit reciprocal movement of the cylindrical contacts which extend through the hermetically sealed envelope. A first switch contact 28 is connected via a flexible bus link 30 to one of the bus conductors 18. The second switch contact 32 is rigidly connected to the resistive element 26, and also is rigidly connected via C-shaped link means 34 to the body 36 of the air cylinder operating means 24.

The air cylinder operating means 24 comprises the body portion 36 with inlet and outlet air pressure connectors 38, 40 therethrough for applying air pressure to reciprocally move the rod 42 which is connected via attachment plate 44, and flexible bus conductor 30 to the first switch contact 28. The reciprocal movement of the rod 42 moves the first switch contact 28 relative to the second switch contact 32 to close the switch with mated contacts, and to open the switch with the contacts spaced apart within the evacuated envelope.

The resistive element 26 includes an end connection flange 46 which is rigidly connected to the other bus conductor 30. The resistive element 26 comprises a tubular conductive body 48 of a predetermined length, diameter, and wall thickness which for a given conductance value for the conductor is divisioned to have the desired resistivity to permit current diversion from the shunt.

The tubular body 48 is sealed at the end connected to the second switch contact 32 by a heat conductive connector plug 50, with a connecting flange 52 about the plug 50. This connecting flange 52 is connected via bolt means 54 to the C-shaped links 34, and the second switch contact 32. The other end of the tubular body 48 is closed by a closure and cooling fluid inlet means 54, with attachment flange 46 about the tubular body 48. An inner tubular member 56 extends from and supported by the closure and cooling fluid inlet means 54 coaxial within the tubular body 48. This inner tubular member 56 acts to direct the cooling fluid such as water against the heat conductive connector plug 50.

A helical member 58 is provided about the inner tubular member 56 and connected thereto by brazing. This helical member 58 is disposed in the cooling fluid return path between the inner tubular member 56 and the resistor tubular body 48 to produce a helical or spiral flow path for the cooling fluid to more effectively cool the resistor tubular body 48. A cooling fluid outlet passage 60 is provided through the resistor tubular body 48 proximate the closure and cooling fluid inlet 54.

By way of example, to provide a resistance value of about 290 micro-ohms for the tubular resistive element 48, a stainless steel tube of about 50 centimeters length and 2.5 inch outside diameter with a 0.25 inch wall thickness is provided. The inner tubular member 56 is also formed of stainless steel, and has a 1.5 inch outside diameter and a wall thickness of 0.065 inch. The helical member 58 is also stainless steel and is brazed to the exterior surface of the inner tubular member 56. The cooling fluid is preferably water from a source not shown which flows through inlet 54 and through the inner tubular member against the heat conductive connector plug 50 and then flows in a helical path back between the tube 48 and the inner tubular member 56 to the outlet passage 60 at a flow rate of from about 2.5 to 5 gallons per minute for a heat dissipation rating of 50 kilowatts.

The switch assembly of the present invention has been described by way of a specific example, but the dimensions and choice of materials can be easily varied to adjust the resistance value. The cooling fluid flow rate can be easily varied to adjust the heat dissipation capability of the assembly. In some applications, a plurality of such switch assemblies can be electrically connected in parallel to produce a switch assembly with higher continuous current carrying capability.

While in FIG. 1, the shunting switch assembly bus conductors 18 and 20 are indicated as connected to the cell terminals 12 and 14 of cell 10, the more typical usage would be for the bus conductors to be connected respectively to the serially connected cells adjacent to the cell to be bypassed or shunted. This permits complete disconnection of the shunted cell for maintenance or replacement with the switch assembly carrying the cell system current.

The C-shaped links 34, best seen in FIG. 2, are formed of rigid insulating material such as reinforced fiberglass to maintain electrical isolation across the switch contacts.

I claim:

1. A low voltage, high current DC switch assembly and integral operating means and resistive element for use as a shunt switch assembly connectable between generally parallel spaced apart electrical terminals or conductors, comprising:

(a) a low voltage DC switch including a pair of relative reciprocally movable contacts disposed within a hermetically sealed envelope portion, with a first switch contact flexibly connectable to a first electrical terminal, and a second switch contact rigidly connectable to a resistive element;

(b) switch operating means having a body portion rigidly connected to the second switch contact, and reciprocally movable drive member connected to the first switch contact to effectuate switch contact opening and closing;

(c) a generally tubular resistive element having first connection means at one end for connection to the second switch contact, and second connection means at the other end for connection to the second electrical terminal, and means for passing cooling fluid through the tubular resistive element.

2. The low voltage, high current DC switch assembly set forth in claim 1, wherein the means for passing cooling fluid through the tubular resistive element comprises an apertured inlet plug sealed within the end of the tubular resistive element connected to the second connection means, and a tubular cooling fluid flow directing member disposed coaxially within the tubular resistive element extending from the apertured inlet plug to proximate the second correction means at the other end of the tubular resistive element.

3. The low voltage, high current DC switch assembly set forth in claim 1, wherein the first connection means comprises a high conductivity cylindrical cooling plug means which is sealed to the end of the tubular resistive element with an apertured first connection end plate about the cooling plug means for electrically connecting the cooling plug means to the second switch contact.

4. The low voltage, high current DC switch assembly set forth in claim 1, wherein the second connection means comprises an apertured second connection plate connected about and extending transverse to the tubular resistive element.

5. The switch assembly set forth in claim 1, wherein the low voltage DC switch hermetically sealed envelope is evacuated.

6. The switch assembly set forth in claim 1, wherein the switch operating means comprises a double acting pneumatic cylinder having an axially reciprocable rod which is connected to the first switch contact, with the body of the pneumatic cylinder rigidly connected to the second switch contact.

7. The switch assembly set forth in claim 1, wherein the generally tubular resistive element is selected of a metal or alloy having a predetermined electrical conductance, and the element is dimensioned to provide a predetermined resistance value.

8. The switch assembly set forth in claim 1, wherein for a predetermined shunt current dissipation characteristic the tubular resistive element is formed of stainless steel.

9. The switch assembly set forth in claim 1, wherein for a predetermined high conductance path the tubular resistance element is formed of copper.

10. The switch assembly set forth in claim 1, wherein means for directing the cooling fluid about the coaxially extending inlet tubulation are provided about the inlet tubulation.

11. The switch assembly set forth in claim 10, wherein the means for directing the cooling fluid about the coaxially extending inlet tubulation is a helical element about the tubulation.

12. The switch assembly set forth in claim 1, wherein the first end plate includes a central copper plug portion which is fitted at the end of the tubular resistive element, and against which cooling fluid is directed from the coaxially extending inlet tubulation, which copper plug portion is connected to a collar portion which is connectable to the end plate of the switch, and where the copper plug portion extends beyond the mating face of the collar portion to permit the copper plug to be mated with the switch contact when the collar is connected to the switch end plate.

13. The switch assembly set forth in claim 1, wherein cooling means which is a fluid is introducible through the inlet cooling tubulation.

14. The low voltage, high current DC switch assembly set forth in claim 1, wherein a plurality of the switch assemblies are electrically connected in parallel with respective first connection means interconnected, and respective second connection means interconnected.

15. A low voltage, high current DC switch assembly with integral switches operating means and resistance means, which assembly comprises:

(a) a low voltage, high current DC switch having a hermetically sealed envelope with a pair of relatively reciprocally movable electrical contacts sealed through the envelope with a first switch contact flexibly connectable to a first electrical terminal, and a second switch contact rigidly connectable to a resistive element;

(b) switch operating means having a body portion rigidly connected to the second switch contact, and reciprocally movable drive member connected to the first switch contact to effectuate switch contact opening and closing;

(c) a generally tubular resistive element having first connection means at one end for connection to the second switch contact, and second connection means at the other end for connection to the second electrical terminal, with means for passing cooling fluid through the tubular resistive element.

16. A low voltage, high current DC switch assembly for use as a shunt switch assembly connectable between generally parallel spaced apart electrical terminals of an electrochemical cell, which shunt switch assembly comprises a plurality of electrically parallel connected sub-assemblies which each comprise:

(a) a low voltage DC switch including a pair of relative reciprocally movable contacts disposed within a hermetically sealed envelope portion, with a first switch contact flexibly connectable to a first electrical terminal, and a second switch contact rigidly connectable to a resistive element;

(b) switch operating means having a body portion rigidly connected to the second switch contact, and reciprocally movable drive member connected to the first switch contact to effectuate switch contact opening and closing;

(c) a generally tubular resistive element having first connection means at one end for connection to the second switch contact, and second connection means at the other end for connection to the second electrical terminal, and means for passing cooling fluid through the tubular resistive element.

* * * * *